US009912059B2

(12) United States Patent
Piskun

(10) Patent No.: US 9,912,059 B2
(45) Date of Patent: Mar. 6, 2018

(54) PROXIMITY COUPLED MULTI-BAND ANTENNA

(71) Applicant: Google Inc., Mountain View, CA (US)

(72) Inventor: Vadim Piskun, San Jose, CA (US)

(73) Assignee: GOOGLE LLC, Mountain View, CA (US)

( * ) Notice: Subject to any disclaimer, the term of this patent is extended or adjusted under 35 U.S.C. 154(b) by 546 days.

(21) Appl. No.: 14/519,985

(22) Filed: Oct. 21, 2014

(65) Prior Publication Data

US 2016/0111788 A1 Apr. 21, 2016

(51) Int. Cl.

| | |
|---|---|
| ***H01Q 9/04*** | (2006.01) |
| ***H01Q 9/16*** | (2006.01) |
| ***H01Q 1/08*** | (2006.01) |
| ***H01Q 1/38*** | (2006.01) |
| ***H01Q 1/40*** | (2006.01) |
| ***H01Q 1/52*** | (2006.01) |
| ***H01Q 9/30*** | (2006.01) |

(Continued)

(52) U.S. Cl.

CPC ..... *H01Q 9/0407* (2013.01); *H01Q 1/085* (2013.01); *H01Q 1/38* (2013.01); *H01Q 1/40* (2013.01); *H01Q 1/521* (2013.01); *H01Q 5/321* (2015.01); *H01Q 9/0457* (2013.01); *H01Q 9/16* (2013.01); *H01Q 9/30* (2013.01); *H01Q 9/42* (2013.01); *H01Q 13/10* (2013.01); *H01Q 21/30* (2013.01)

(58) Field of Classification Search

CPC ..... H01Q 5/321; H01Q 1/38; H01Q 1/40; H01Q 1/521; H01Q 9/0457; H01Q 9/16; H01Q 9/30; H01Q 9/42; H01Q 13/10; H01Q 21/30; H01Q 9/0407; H01Q 1/085

See application file for complete search history.

(56) References Cited

U.S. PATENT DOCUMENTS

| | | | |
|---|---|---|---|
| 6,166,694 | A | 12/2000 | Ying et al. |
| 8,059,049 | B2 | 11/2011 | Quan et al. |

(Continued)

FOREIGN PATENT DOCUMENTS

| | | | |
|---|---|---|---|
| CN | 102403571 | A | 4/2012 |
| EP | 2390955 | A1 | 11/2011 |
| WO | 2013123109 | A1 | 8/2013 |

OTHER PUBLICATIONS

PCT/US2015/56252, International Search Report and Written Opinion issued in PCT/US2015/56252 dated Jan. 26, 2016.

(Continued)

*Primary Examiner* — Dameon E Levi
*Assistant Examiner* — David Lotter
(74) *Attorney, Agent, or Firm* — Morris & Kamlay LLP

(57) ABSTRACT

Systems and techniques are provided for proximity coupled multi-band antenna. A two-layer flex antenna includes a first element and a second element arranged with a gap between the first element and the second element. A dielectric material covers the two-layer flex antenna and the gap. A thin trace antenna is arranged on top of the dielectric material such that a first portion of the thin trace antenna is partially congruent with the first element of two-layer flex antenna, a second portion of the thin trace antenna crosses the gap between the first element and the second element of the two-layer flex antenna, and a third portion of the thin trace antenna extends away from the second element of the two-layer flex antenna.

21 Claims, 7 Drawing Sheets

(51) Int. Cl.

| | |
|---|---|
| ***H01Q 9/42*** | (2006.01) |
| ***H01Q 13/10*** | (2006.01) |
| ***H01Q 21/30*** | (2006.01) |
| ***H01Q 5/321*** | (2015.01) |

(56) References Cited

U.S. PATENT DOCUMENTS

| | | | | |
|---|---|---|---|---|
| 8,810,470 | B2 | 8/2014 | Heckler et al. | |
| 2008/0272971 | A1 | 11/2008 | Kanno | |
| 2011/0057842 | A1* | 3/2011 | Rothkopf | H01Q 1/12 343/700 MS |
| 2013/0154886 | A1 | 6/2013 | Isohätälä | |
| 2014/0008446 | A1 | 1/2014 | Carr | |
| 2015/0015446 | A1* | 1/2015 | Jagielski | H01Q 1/38 343/767 |

OTHER PUBLICATIONS

Krauss, et al., "Antennas: For All Applications", McGraw-Hill Science/Engineering/Math, Nov. 12, 2001, pp. 812, ISBN 10 0-07-232103-2.

* cited by examiner

PROXIMITY COUPLED MULTI-BAND ANTENNA

BACKGROUND

A multi-band antenna may include antenna elements that can operate on separate frequency bands. This may allow for a single antenna to be used in an electronic device that may need to be able to send and receive signals on distinct frequency bands. In order to operate on the separate frequency bands, the multi-band antenna may include a separate antenna element for each frequency band. This may result in a multi-band antenna having a larger footprint than a single band antenna, as each antenna element of the multi-band antenna may be arranged to not touch or overlap the other antenna elements except at a common feed point. Multi-band antennas used inside of electronic devise may end up with lower efficiency or narrower frequency bandwidths due to the lack of space for the separate antenna elements.

BRIEF SUMMARY

According to an embodiment of the disclosed subject matter, a two-layer flex antenna may include a first element and a second element arranged with a gap between the first element and the second element. A dielectric material may cover the two-layer flex antenna and the gap. A thin trace antenna may be placed on top of the dielectric material such that a first portion of the thin trace antenna is partially congruent with the first element of two-layer flex antenna, a second portion of the thin trace antenna may cross the gap between the first element and the second element of the two-layer flex antenna, and a third portion of the thin trace antenna may extend away from the second element of the two-layer flex antenna An end of the first element of the two-layer flex antenna may be attached to a ground plane. The two-layer flex antenna may include copper. The gap between the first element and the second element of the two-layer flex antenna may be at most 0.1 mm. The two-layer flex antenna and the thin trace antenna may have the same feed point. The two-layer flex antenna may be an asymmetric dipole antenna.

The two-layer flex antenna may transmit and receive at a lower frequency than the thin trace antenna. The third portion of the thin trace antenna may extend away from the second element of the two-layer flex antenna at an angle such that the third portion of the thin trace antenna may be perpendicular to or point away from the first portion of the thin trace antenna. The first element of the two-layer flex antenna may be L-shaped. A current in the thin trace antenna may induce a voltage in the gap. The gap is a radiator for the thin trace antenna. The ground plane may be a radiator for the two-layer flex antenna. The ground plane may be a printed circuit board.

According to an embodiment of the disclosed subject matter, a means for obtaining a two-layer flex antenna, a means for attaching a dielectric material to the two-layer flex antenna, and a means for attaching a thin trace antenna to dielectric, are included.

Systems and techniques disclosed herein may allow for a proximity coupled multi-band antenna. Additional features, advantages, and embodiments of the disclosed subject matter may be set forth or apparent from consideration of the following detailed description, drawings, and claims. Moreover, it is to be understood that both the foregoing summary and the following detailed description are examples and are intended to provide further explanation without limiting the scope of the claims.

BRIEF DESCRIPTION OF THE DRAWINGS

The accompanying drawings, which are included to provide a further understanding of the disclosed subject matter, are incorporated in and constitute a part of this specification. The drawings also illustrate embodiments of the disclosed subject matter and together with the detailed description serve to explain the principles of embodiments of the disclosed subject matter. No attempt is made to show structural details in more detail than may be necessary for a fundamental understanding of the disclosed subject matter and various ways in which it may be practiced.

DETAILED DESCRIPTION

Figure 1:
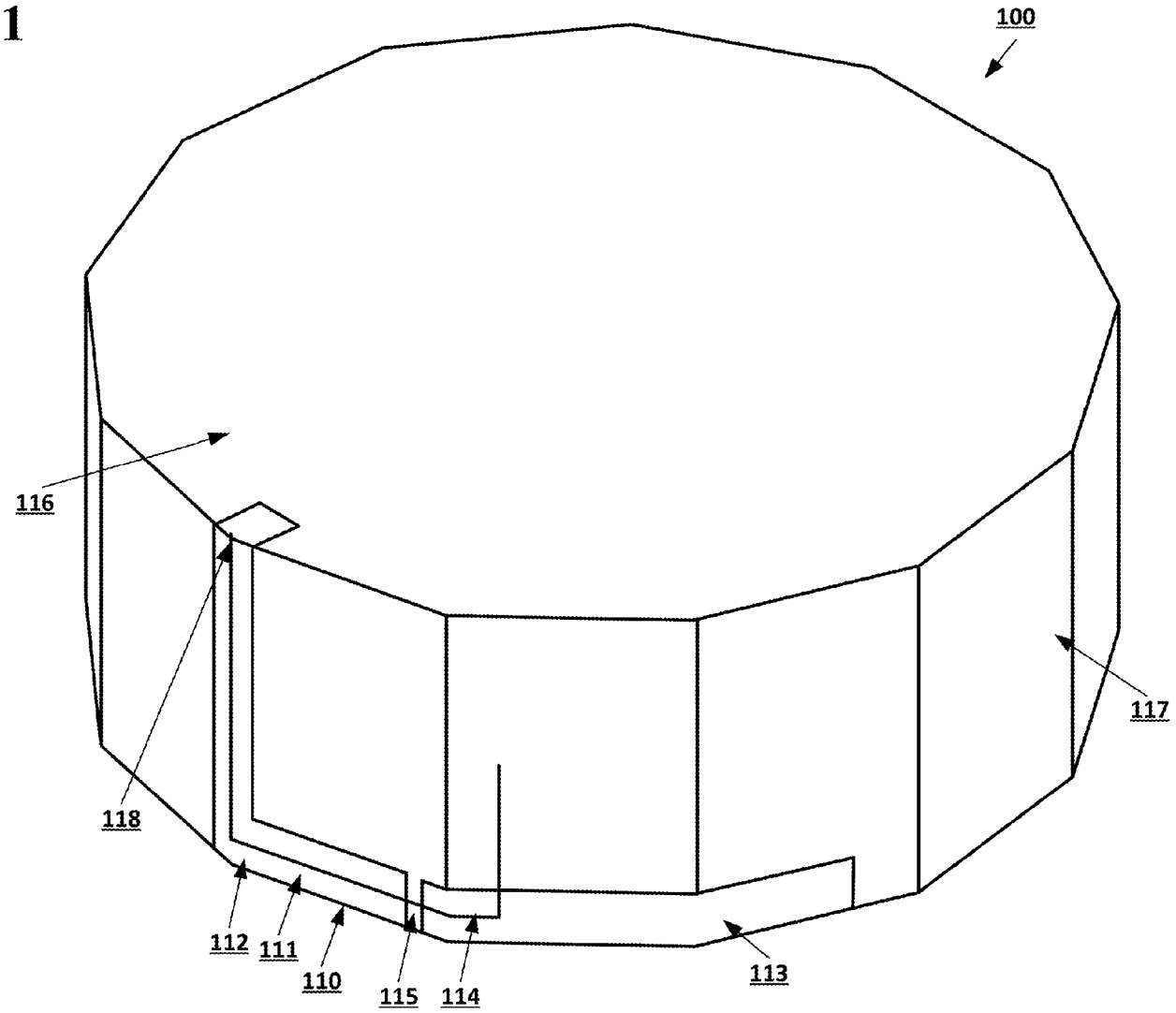
FIG. 1 shows an example perspective view of a proximity coupled multi-band antenna according to an implementation of the disclosed subject matter.

A proximity coupled multi-band antenna may include antenna elements for separate frequency bands while not requiring additional surface area for the multi-band antenna. A proximity coupled multi-band antenna may include three layers. The first layer may be a two-layer flex antenna, which may be an asymmetric dipole antenna divided into two separate elements. There may be a gap between the two separate elements. The two-layer flex antenna may be connected to a ground plane, which may act as a radiator. The second layer may be a dielectric material that may cover the two-layer flex antenna. The third layer may be a thin trace that is congruent with the first element of the two-layer flex antenna, crosses the gap, and is partially congruent with the second element of the two-layer flex antenna before extending outwards from the second element. The dielectric may or may not extend underneath the extension of the thin trace antenna. The thin trace may be made of any suitable material for a high frequency antenna.

The first layer of the proximity coupled multi-band antenna may be a two-layer flex antenna. The first element of the two-layer flex antenna may be, for example, approximately L-shaped, with the end of the first leg of the L connected to a ground plane. The ground plane may be made of any suitable material, such as, for example, copper, and may act as a radiator for the two-layer flex antenna. The ground plane may be, for example, a printed circuit board (PCB). The second element may be placed near the end of the second leg of the L-shaped first element, with a gap in between the first element and the second element. The gap may be a small gap, for example, the gap may be 0.1 mm. The second element may have the same width as the second leg of the first element, and may have a rectangular shape. The two-layer flex antenna may be made of any suitable material, such as, for example, copper.

The second layer of the proximity coupled multi-band antenna may by a dielectric layer. The dielectric layer may be made of any suitable dielectric material, and may cover all of the two-layer flex antenna of the first layer as well as the gap between the first element and the second element of the two-layer flex antenna. The dielectric material may extend beyond the two-layer flex antenna, covering more surface area than that occupied by the two-layer flex antenna. The dielectric material may extend under part of the thin trace antenna that extends away from the two-layer flex antenna.

The third layer of the proximity coupled multi-band antenna may be a thin trace antenna. The thin trace antenna may be placed atop the dielectric layer, and may be positioned to run down the center of the two-layer flex antenna. The thin trace antenna may run down first leg of the first element of the two-layer flex antenna perpendicular to the end of the first leg, bend at a right angle to run down the second leg of the two-layer flex antenna perpendicular to the end of the second leg, and cross over the gap between the first element and the second element of the two-layer flex antenna. The thin trace antenna may then run down the center of the second element of the two layer flex antenna, bend at a right angle in the middle of the second element of the two-layer flex antenna, and extend beyond the second element of the two-layer flex antenna at any suitable angle, for example, parallel to or angled away from the portion of the thin trace antenna that runs down the first leg of the first element of the two-layer flex antenna. The dielectric material may, or may not, be underneath the part of the thin trace antenna that extends beyond the second element of the two-layer flex antenna. The thin trace antenna may be made of any suitable material.

The two-layer flex antenna may be excited by low frequencies. The thin trace antenna may be excited by high frequencies. For example. The two-layer flex antenna may operate at frequencies around 700 Mhz, while the thin trace antenna may operate at frequencies around 1500 Mhz. The gap between the first element and the second element of the two-layer flex antenna may act as a radiator for the thin trace antenna, as current in the thin trace antenna may induce a voltage in the gap. The proximity coupled multi-band antenna may be used for electronic communications, transmitting and receiving on any two separate frequency bands.

The two-layer flex antenna and the thin trace antenna may be fed by any suitable amplifier, running off any suitable power source, at a feed point near the connection between the two-layer flex antenna and the ground plane. The power source may be, for example, a battery.

The proximity coupled multi-band antenna may be attached to any suitable electronic device. For example, the proximity coupled multi-band antenna may be attached to the plastic body of a battery powered electronic device that may be for use in, for example, a home automation system.

FIG. 1 shows an example perspective view of a proximity coupled multi-band antenna according to an implementation of the disclosed subject matter. A device 100, which may any suitable electronic device, may include a proximity coupled multi-band antenna 110. The device 100 may be, for example, any suitable computing device, such as laptop, smartphone, tablet, or other computing device, or any component thereof, or any suitable electronic device, such as, for example, an electronic device used in home automation. The proximity coupled multi-band antenna 110 may be arranged on a plastic wall 117 of the device 100. The proximity coupled multi-band antenna 110 may include a two-layer flex antenna 111 and a thin trace antenna 114. The two-layer flex antenna 111 may be an asymmetric dipole antenna, and may include a first element 112 and a second element 113. The first element 112 and the second element 113 may be arranged on the device 100 so that there is a gap 115 in between them. The two-layer flex antenna may be made of any suitable material, such as, for example, copper.

The thin trace antenna 114 may follow the shape of the two-layer flex antenna 111, cross over the gap 115, and then extend away from the second element 113 of the two-layer flex antenna 111. There may be a dielectric layer in between the thin trace antenna 114 and the two-layer flex antenna which may prevent them from coming into physical contact. The thin trace antenna 114 may be made of any suitable material.

The two-layer flex antenna 111 may be connected to a ground plane 116, which may be, for example, a PCB of the device 100. The ground plane 116 may made of any suitable material, such as, for example, copper, and may act as a radiator for the two-layer flex antenna 111. Both the two-layer flex antenna 111 and the thin trace antenna 114 may be fed at a feed point 118, which may be located near where the two-layer flex antenna 111 connects to the ground plane 116.

Figure 2A:
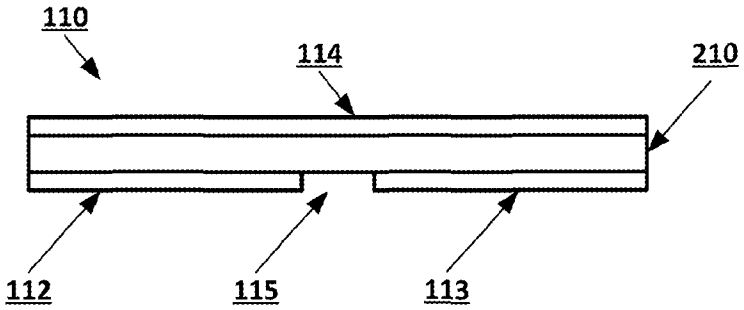
FIG. 2*a* shows an example side view of a proximity coupled multi-band antenna according to an according to an implementation of the disclosed subject matter.

FIG. 2*a* shows an example side view of a proximity coupled multi-band antenna according to an according to an implementation of the disclosed subject matter. A dielectric layer 210 may be in between the thin trace antenna 114 and the two-layer flex antenna 111. The dielectric layer 210 may cover the gap 115 between the first element 112 and the second element 113 of the two-layer flex antenna 111.

Figure 2B:
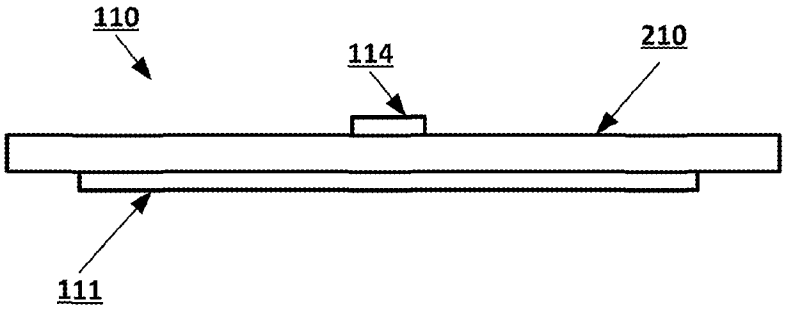
FIG. 2*b* shows an example cross-sectional view of a proximity coupled multi-band antenna according to an implementation of the disclosed subject matter.

FIG. 2*b* shows an example cross-sectional view of a proximity coupled multi-band antenna according to an implementation of the disclosed subject matter. The dielectric layer 210 may cover more surface area than the two-layer flex antenna 111, extending beyond the edge of the two layer flex antenna 111. The thin trace antenna 114 may be thinner than both the two-layer flex antenna 114 and the dielectric layer 210.

Figure 3A:
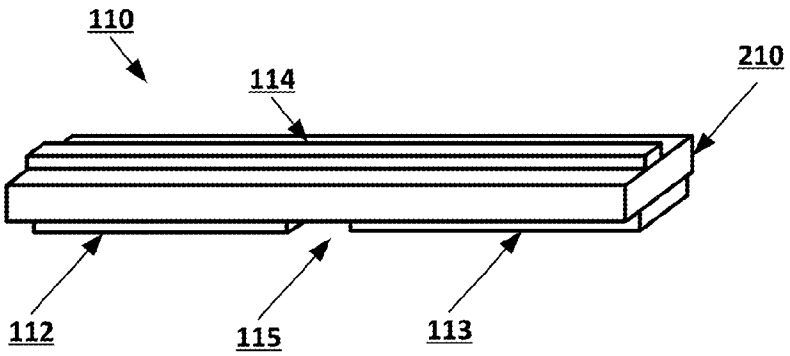
FIG. 3*a* shows an example perspective view of a proximity coupled multi-band antenna according to an implementation of the disclosed subject matter.

FIG. 3*a* shows an example perspective view of a proximity coupled multi-band antenna according to an implementation of the disclosed subject matter. The thin trace antenna 114 may be arranged to run down or near the center of the dielectric layer 210 and the two-layer flex antenna 111, crossing over the gap 115 between the first element 112 and the second element 113. Current running through the thin trace antenna 114 may induce voltage in the gap 115, allowing the gap 115 to act as a radiator for the thin trace antenna 114.

Figure 3B:
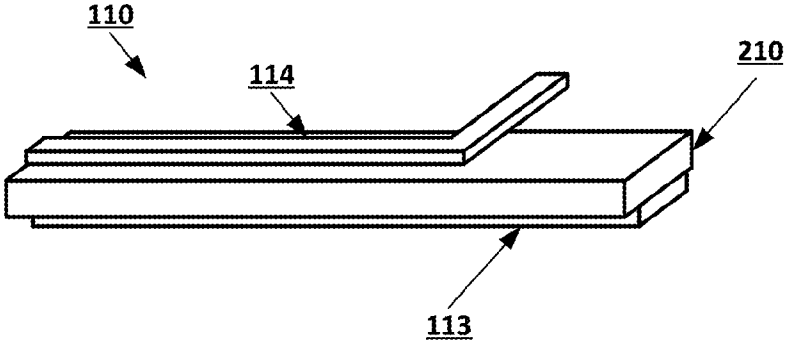
FIG. 3*b* shows an example perspective view of a proximity coupled multi-band antenna according to an implementation of the disclosed subject matter.

FIG. 3*b* shows an example perspective view of a proximity coupled multi-band antenna according to an implementation of the disclosed subject matter. The thin trace antenna 114 may extend beyond the second element 113 of the two-layer flex antenna 111. For example, the thin trace antenna 114 may run down or near the center of the second element 113 for part of the length of the second element 113, and then bend at right angle and extend perpendicularly to the edge of the second element 113. At the edge of the second element 113, the thin trace antenna 114 may extend away from the second element 113 at any suitable angle. The dielectric layer 210 may or may not extend underneath the portion of the thin trace antenna 114 that extends beyond the second element 113.

Figure 4B:
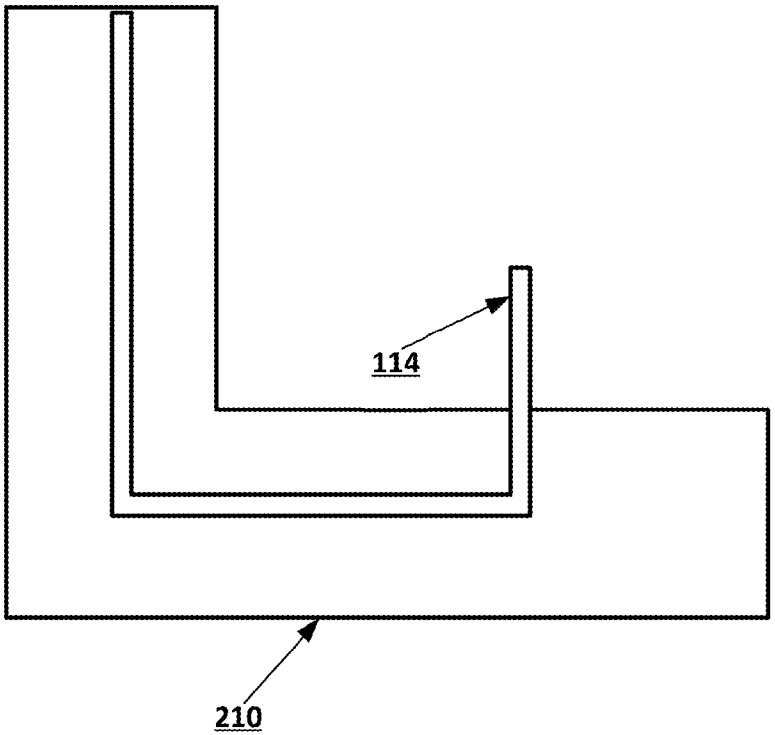
FIG. 4*b* shows an example of a second and third layer view of a proximity coupled multi-band antenna according to an implementation of the disclosed subject matter
Figure 4A:
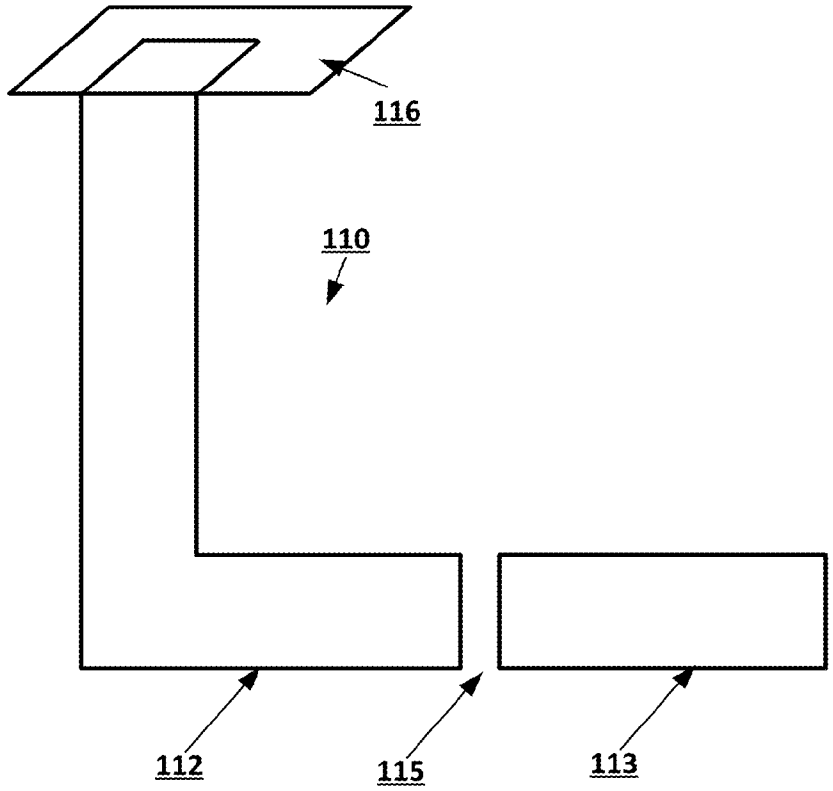
FIG. 4*a* shows an example of a first layer view of a proximity coupled multi-band antenna according to an implementation of the disclosed subject matter.

FIG. 4*a* shows an example of a first layer view of a proximity coupled multi-band antenna according to an implementation of the disclosed subject matter. The first layer of the proximity coupled multi-band antenna 110 may by the two-layer flex antenna 111, which may be, for example, and asymmetric dipole antenna with a first element 112 and a second element 113. The first element 112 may be, for example, L-shaped, and may be connected to the ground plane 116. There may be a gap 115 between the first element 112 and the second element 113, which may be, for example, rectangular.

FIG. 4*b* shows an example of a second and third layer view of the proximity coupled multi-band antenna 110 according to an implementation of the disclosed subject matter. The second layer of the proximity coupled multi-band antenna 110 may a dielectric layer 210, which may be made of any suitable dielectric material. The dielectric layer 210 may be shaped to cover, and extend beyond, the surface area covered by the two-layer flex antenna 111. The dielectric layer 210 may extend underneath the thin trace antenna 114, including the portion of the thin trace antenna 114 that extends beyond the second element 113. The dielectric layer 210 may also cover the gap 115.

The third layer of the proximity coupled multi-band antenna 110 may be the thin trace antenna 114, which may arranged on top of the dielectric layer 210. The thin trace antenna 114 may follow the shape of the dielectric layer 210, cross the gap 115, and then extend beyond the second element 113 of the two-layer flex antenna 111.

Figure 5:
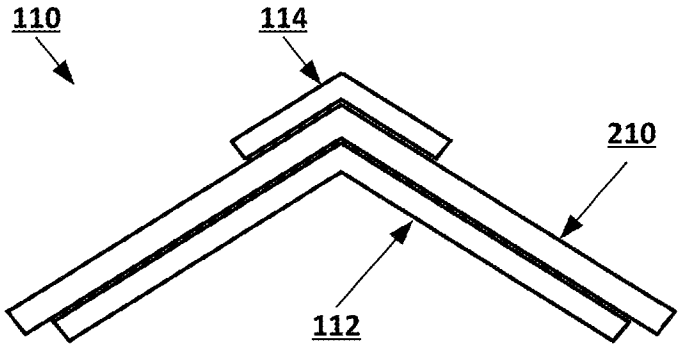
FIG. 5 shows an example cross-sectional view of a proximity coupled multi-band antenna according to an implementation of the disclosed subject matter.

FIG. 5 shows an example cross-sectional view of a proximity coupled multi-band antenna according to an implementation of the disclosed subject matter. The proximity coupled multi-band antenna 110 may be flexible, and may be installed over angled surfaces. For example, the plastic walls 117 of the device 100 may meet at corners, and the proximity coupled multi-band antenna 110 may be installed over these corners. This may result in flexure of the proximity coupled multi-band antenna 110, as each of the two-layer flex antenna 111, the dielectric layer 210, and the thin trace 114 may be flexible.

Figure 6:
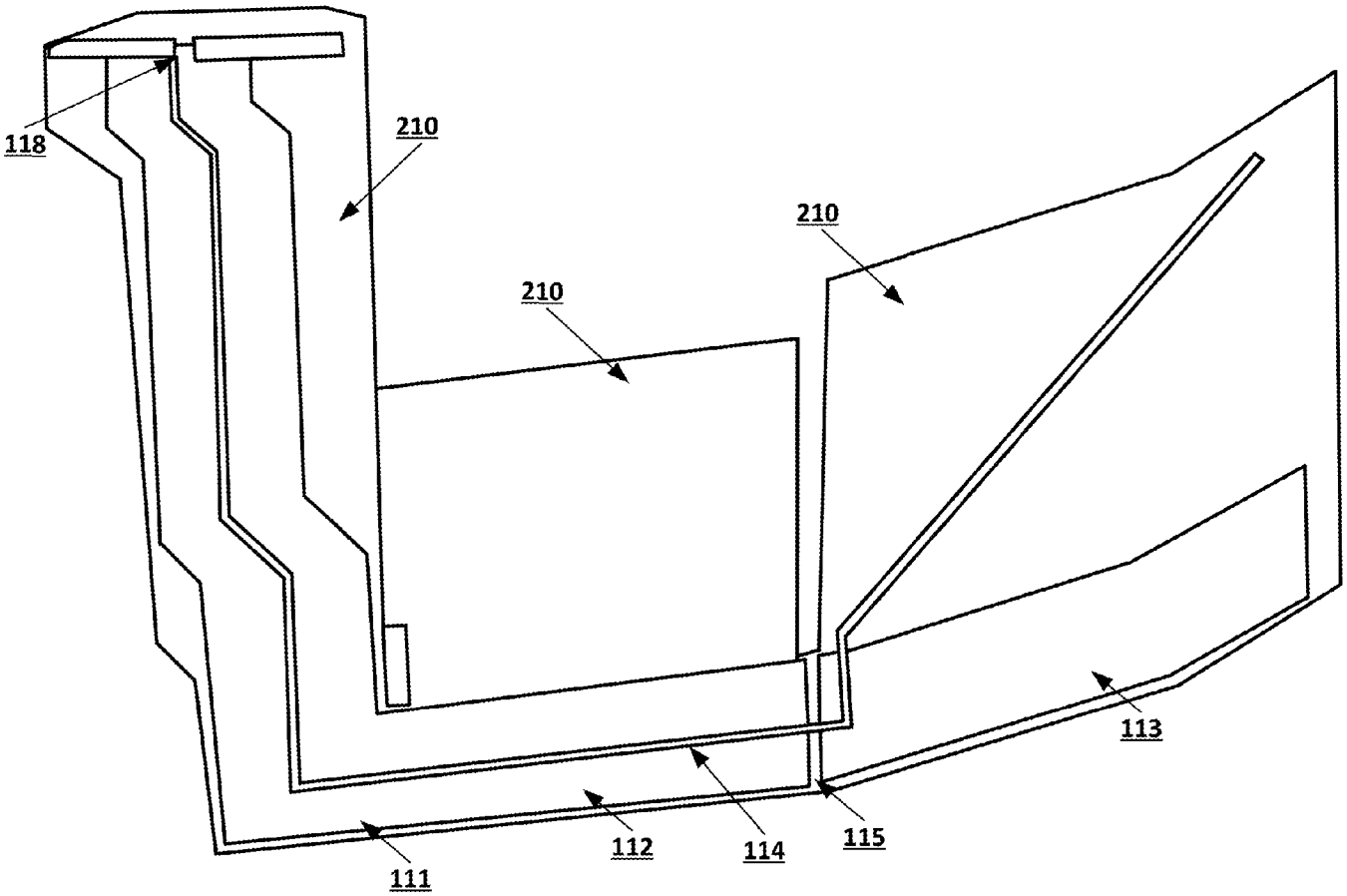
FIG. 6 shows an example view of a proximity coupled multi-band antenna according to an implementation of the disclosed subject matter.

FIG. 6 shows an example view of a proximity coupled multi-band antenna according to an implementation of the disclosed subject matter. The first element 112 of the two-layer flex antenna 111 may be approximately L-shaped, and the thin trace antenna 114 may run down the two-layer flex antenna 111 on top of the dielectric layer 210. The thin trace antenna 114 may cross the gap 115, and then angle towards the edge of the second element 113, for example, at a right angle or any other suitable angle. At the edge of the second element 113, the thin trace antenna 114 may extend away from the second element 113 at any suitable angle. For example, the thin trace antenna 114 may be perpendicular to the second element 113, or may extend at an angle away from the second element 113 such that the portion of the thin trace antenna 114 is angled away from the portion of the thin trace antenna 114 that runs down the first element 112.

Figure 7:
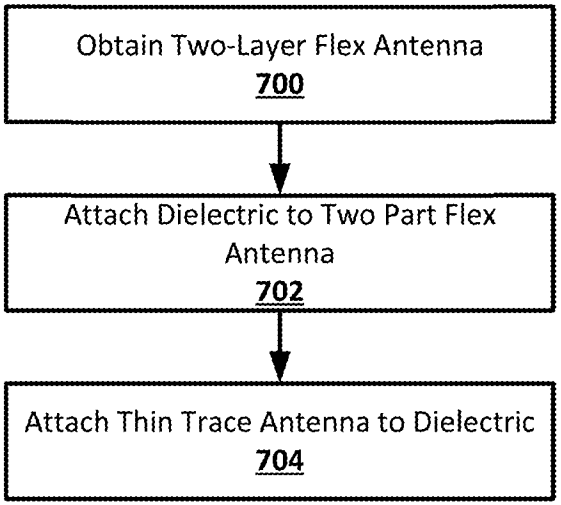
FIG. 7 shows an example of a process for assembling a proximity coupled multi-band antenna according to an implementation of the disclosed subject matter.

FIG. 7 shows an example of a process for assembling a proximity coupled multi-band antenna according to an implementation of the disclosed subject matter. At 700, a two-layer flex antenna may be obtained. For example, the two-layer flex antenna 111, including the first element 112 and the second element 113, may be obtained.

At 702, a dielectric may be attached to the two-layer flex antenna. For example, the dielectric layer 210, made of any suitable dielectric material, may be attached to the two-layer flex antenna 111 in any suitable manner. The dielectric layer 210 may cover and extend beyond the surface area of the two-layer flex antenna 111.

At 703, a thin trace antenna may be attached to the dielectric. For example, the thin trace antenna 114 may be attached, in any suitable manner, to the dielectric layer 210. The thin trace 114 may run down or near the center of the dielectric layer 210 and the two-layer flex antenna 111, cross the gap 115, and then extend away from the two-layer flex antenna 111, for example, perpendicular to the length of the second element 113 to the edge of the second element 113, and the away from the second element 113 at any suitable angle.

Figure 8:
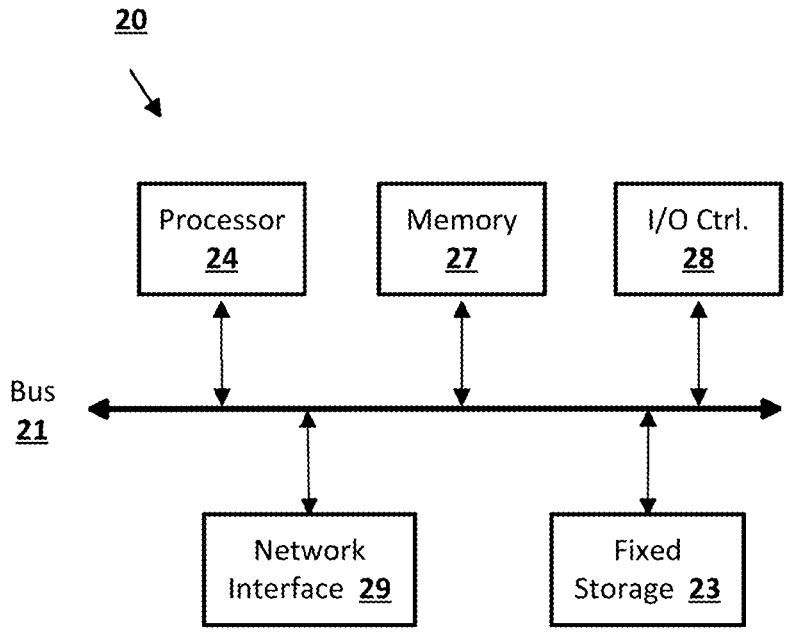
FIG. 8 shows a computer according to an embodiment of the disclosed subject matter.

Embodiments of the presently disclosed subject matter may be implemented in and used with a variety of component and network architectures. FIG. 8 is an example computer system 20 suitable for implementing embodiments of the presently disclosed subject matter. The computer 20 includes a bus 21 which interconnects major components of the computer 20, such as one or more processors 24, memory 27 such as RAM, ROM, flash RAM, or the like, an input/output controller 28, and fixed storage 23 such as a hard drive, flash storage, SAN device, or the like. It will be understood that other components may or may not be included, such as a user display such as a display screen via a display adapter, user input interfaces such as controllers and associated user input devices such as a keyboard, mouse, touchscreen, or the like, and other components known in the art to use in or in conjunction with general-purpose computing systems.

The bus 21 allows data communication between the central processor 24 and the memory 27. The RAM is generally the main memory into which the operating system and application programs are loaded. The ROM or flash memory can contain, among other code, the Basic Input-Output system (BIOS) which controls basic hardware operation such as the interaction with peripheral components. Applications resident with the computer 20 are generally stored on and accessed via a computer readable medium, such as the fixed storage 23 and/or the memory 27, an optical drive, external storage mechanism, or the like.

Each component shown may be integral with the computer 20 or may be separate and accessed through other interfaces. Other interfaces, such as a network interface 29, may provide a connection to remote systems and devices via a telephone link, wired or wireless local- or wide-area network connection, proprietary network connections, or the like. For example, the network interface 29 may allow the computer to communicate with other computers via one or more local, wide-area, or other networks, as shown in FIG. 9.

Many other devices or components (not shown) may be connected in a similar manner, such as document scanners, digital cameras, auxiliary, supplemental, or backup systems, or the like. Conversely, all of the components shown in FIG.

8 need not be present to practice the present disclosure. The components can be interconnected in different ways from that shown. The operation of a computer such as that shown in FIG. 8 is readily known in the art and is not discussed in detail in this application. Code to implement the present disclosure can be stored in computer-readable storage media such as one or more of the memory 27, fixed storage 23, remote storage locations, or any other storage mechanism known in the art.

Figure 9:
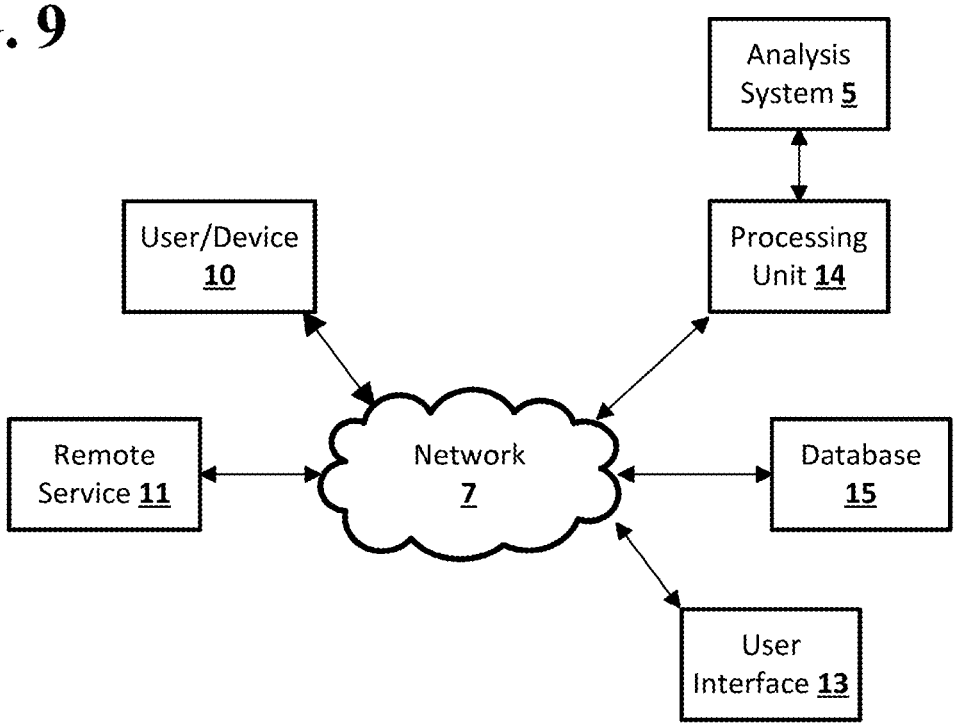
FIG. 9 shows a network configuration according to an embodiment of the disclosed subject matter.

FIG. 9 shows an example arrangement according to an embodiment of the disclosed subject matter. One or more clients 10, 11, such as local computers, smart phones, tablet computing devices, remote services, and the like may connect to other devices via one or more networks 7. The network may be a local network, wide-area network, the Internet, or any other suitable communication network or networks, and may be implemented on any suitable platform including wired and/or wireless networks. The clients 10, 11 may communicate with one or more computer systems, such as processing units 14, databases 15, and user interface systems 13. In some cases, clients 10, 11 may communicate with a user interface system 13, which may provide access to one or more other systems such as a database 15, a processing unit 14, or the like. For example, the user interface 13 may be a user-accessible web page that provides data from one or more other computer systems. The user interface 13 may provide different interfaces to different clients, such as where a human-readable web page is provided to web browser clients 10, and a computer-readable API or other interface is provided to remote service clients 11. The user interface 13, database 15, and processing units 14 may be part of an integral system, or may include multiple computer systems communicating via a private network, the Internet, or any other suitable network. Processing units 14 may be, for example, part of a distributed system such as a cloud-based computing system, search engine, content delivery system, or the like, which may also include or communicate with a database 15 and/or user interface 13. In some arrangements, an analysis system 5 may provide back-end processing, such as where stored or acquired data is pre-processed by the analysis system 5 before delivery to the processing unit 14, database 15, and/or user interface 13. For example, a machine learning system 5 may provide various prediction models, data analysis, or the like to one or more other systems 13, 14, 15.

In situations in which the implementations of the disclosed subject matter collect personal information about users, or may make use of personal information, the users may be provided with an opportunity to control whether programs or features collect user information (e.g., a user's performance score, a user's work product, a user's provided input, a user's geographic location, and any other similar data associated with a user), or to control whether and/or how to receive instructional course content from the instructional course provider that may be more relevant to the user. In addition, certain data may be treated in one or more ways before it is stored or used, so that personally identifiable information is removed. For example, a user's identity may be treated so that no personally identifiable information can be determined for the user, or a user's geographic location associated with an instructional course may be generalized where location information is obtained (such as to a city, ZIP code, or state level), so that a particular location of a user cannot be determined. Thus, the user may have control over how information is collected about the user and used by an instructional course provider.

The foregoing description, for purpose of explanation, has been described with reference to specific embodiments. However, the illustrative discussions above are not intended to be exhaustive or to limit embodiments of the disclosed subject matter to the precise forms disclosed. Many modifications and variations are possible in view of the above teachings. The embodiments were chosen and described in order to explain the principles of embodiments of the disclosed subject matter and their practical applications, to thereby enable others skilled in the art to utilize those embodiments as well as various embodiments with various modifications as may be suited to the particular use contemplated.

The invention claimed is:

1. An apparatus comprising:

a two-layer flex antenna comprising a first element and a second element disposed with a gap between the first element of the two-layer flex antenna and the second element of the two-layer flex antenna to form a dipole antenna;

a dielectric material covering the two-layer flex antenna and the gap; and a thin trace antenna disposed on top of the dielectric material such that a first portion of the thin trace antenna is congruent with the first element of two-layer flex antenna, a second portion of the thin trace antenna crosses the gap between the first element and the second element of the two-layer flex antenna, and a third portion of the thin trace antenna extends away from the second element of the two-layer flex antenna, wherein the thin trace antenna is thinner than the two-layer flex antenna.

2. The apparatus of claim 1, wherein an end of the first element of the two-layer flex antenna is attached to a ground plane.

3. The apparatus of claim 1, wherein the two-layer flex antenna comprises copper.

4. The apparatus of claim 1, wherein the gap between the first element and the second element of the two-layer flex antenna is at most 0.1 mm.

5. The apparatus of claim 1, wherein the two-layer flex antenna and the thin trace antenna have the same feed point.

6. The apparatus of claim 1, wherein the two-layer flex antenna is an asymmetric dipole antenna.

7. The apparatus of claim 1, wherein the two-layer flex antenna transmits and receives at a lower frequency than the thin trace antenna.

8. The apparatus of claim 1, wherein the third portion of the thin trace antenna extends away from the second element of the two-layer flex antenna at an angle such that the third portion of the thin trace antenna is perpendicular to or points away from the first portion of the thin trace antenna.

9. The apparatus of claim 1, wherein the first element of the two-layer flex antenna is L-shaped.

10. The apparatus of claim 1, wherein a current in the thin trace antenna induces a voltage in the gap.

11. The apparatus of claim 1, wherein the gap is a radiator for the thin trace antenna.

12. The apparatus of claim 2, wherein the ground plane is a radiator for the two-layer flex antenna.

13. The apparatus of claim 2, wherein the ground plane is on a printed circuit board.

14. An apparatus comprising:

a proximity coupled multi-band antenna comprising a two-layer flex antenna with a gap, a dielectric layer, and a thin trace antenna, wherein the thin trace antenna is thinner than the two-layer flex antenna, the two-layer flex antenna comprises a first element and a second element disposed with the gap between the first element of the two-layer flex antenna and the second element of the two-layer flex antenna to form a dipole antenna;

a wall; and a ground plane, wherein the ground plane is attached to the wall, and wherein the two-layer flex antenna is attached to the wall.

15. The apparatus of claim 14, wherein:

the dielectric layer comprises a dielectric material covering the two-layer flex antenna and the gap, and the thin trace antenna is disposed on top of the dielectric material such that a first portion of the thin trace antenna is congruent with the first element of two-layer flex antenna, a second portion of the thin trace antenna crosses the gap between the first element and the second element of the two-layer flex antenna, and a third portion of the thin trace antenna extends away from the second element of the two-layer flex antenna, wherein the thin trace antenna is thinner than the two-layer flex antenna.

16. The apparatus of claim 14, wherein an end of the two-layer flex antenna is attached to the ground plane, and wherein the ground plane is a radiator for the two-layer flex antenna.

17. The apparatus of claim 14, wherein the gap between the first element and the second element of the two-layer flex antenna is at most 0.1 mm.

18. The apparatus of claim 14, wherein the proximity coupled multi-band antenna is at least partially attached to the wall.

19. The apparatus of claim 14, wherein the gap is a radiator for the thin trace antenna.

20. The apparatus of claim 14, wherein the two-layer flex antenna operates on a first frequency band and the thin trace antenna operates on a second frequency band, the first frequency band being lower than the second frequency band.

21. A method comprising:

obtaining a two-layer flex antenna comprising a first element and a second element disposed with a gap between the first element of the two-layer flex antenna and the second element of the two-layer flex antenna to form a dipole antenna;

attaching a dielectric material to the two-layer flex antenna; and attaching a thin trace antenna to the dielectric material, wherein the thin trace antenna is thinner than the two-layer flex antenna.

* * * * *